US005986620A

United States Patent [19]

Filipovic

[11] Patent Number: 5,986,620

[45] **Date of Patent: *Nov. 16, 1999**

[54] DUAL-BAND COUPLED SEGMENT HELICAL ANTENNA

[75] Inventor: Daniel Filipovic, San Diego, Calif.

[73] Assignee: Qualcomm Incorporated, San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/690,117

[22] Filed: Jul. 31, 1996

[51] Int. Cl.[6] ..... H01Q 1/36

[52] U.S. Cl. ..... 343/895; 343/853

[58] Field of Search ..... 343/895, 702, 343/700 MS, 853, 725; H01Q 1/36

[56] References Cited

U.S. PATENT DOCUMENTS

| | | | |
|---|---|---|---|
| 3,369,243 | 2/1968 | Greiser | 343/770 |
| 4,008,479 | 2/1977 | Smith | 343/895 |
| 4,148,030 | 4/1979 | Foldes | 343/895 |
| 4,349,824 | 9/1982 | Harris | 343/700 MS |
| 4,400,702 | 8/1983 | Tanaka | 343/790 |
| 4,658,262 | 4/1987 | DuHamel | 343/792.5 |
| 4,725,845 | 2/1988 | Phillips | 343/702 |
| 5,134,422 | 7/1992 | Auriol | 343/895 |
| 5,198,831 | 3/1993 | Burrell et al. | 343/701 |
| 5,255,005 | 10/1993 | Terret et al. | 343/895 |
| 5,298,910 | 3/1994 | Takei et al. | 343/895 |
| 5,346,300 | 9/1994 | Yamamoto et al. | 343/895 |
| 5,349,365 | 9/1994 | Ow et al. | 343/895 |
| 5,359,340 | 10/1994 | Yokota | 343/792 |
| 5,450,093 | 9/1995 | Kim | 343/895 |
| 5,479,180 | 12/1995 | Lenzing et al. | 343/729 |
| 5,485,170 | 1/1996 | McCarrick | 343/895 |
| 5,541,617 | 7/1996 | Connolly et al. | 343/895 |
| 5,559,524 | 9/1996 | Takei et al. | 343/895 |
| 5,581,268 | 12/1996 | Hirshfield | 343/701 |
| 5,600,341 | 2/1997 | Thill et al. | 343/895 |
| 5,612,707 | 3/1997 | Vaughan et al. | 343/895 |

FOREIGN PATENT DOCUMENTS

| | | | |
|---|---|---|---|
| 0320404 | 6/1989 | European Pat. Off. | H01Q 11/08 |
| 0715369 | 6/1996 | European Pat. Off. | H01Q 11/08 |
| 0757406 | 2/1997 | European Pat. Off. | H01Q 11/08 |
| 0905513 | 11/1997 | European Pat. Off. | H01Q 11/08 |
| 03236612 | 10/1991 | Japan | H01Q 9/27 |
| 9711507 | 3/1997 | WIPO | H01Q 11/08 |
| 9741695 | 11/1997 | WIPO . | |
| 9805087 | 2/1998 | WIPO | H01Q 1/36 |

OTHER PUBLICATIONS

John D. Kraus, "Antennas", Second Edition, McGraw–Hill, Inc., New York, 1988, Chapter 7 and Section 11–9.

Jalil Rashed et al., "A New Class of Resonant Antennas", *IEEE Transactions on Antennas and Propagation,* vol. 39, No. 9, Sep. 9, 1991, pp. 1428–1430.

*Primary Examiner*—Don Wong
*Assistant Examiner*—Tho Phan
*Attorney, Agent, or Firm*—Russell B. Miller; Gregory D. Ogrod

[57] ABSTRACT

A dual-band coupled-segment helical antenna provides operation in two frequency bands. The dual-band coupled-segment helical antenna includes a radiator portion having two sets of one or more helically wound radiators extending from one end of the radiator portion to the other end of the radiator portion. Radiators of the first set of radiators are comprised of two segments: a first radiator segment extends in a helical fashion from one end of the radiator portion toward the other end of the radiator portion; and a second radiator segment is U-shaped and extends in a helical fashion from the first end of the radiator portion toward the second end of the radiator portion. Radiators of the second set of radiators are comprised of a radiator disposed within said U-shaped segment. The first set of radiators resonates at a first frequency and the second set of radiators resonates at a second frequency thereby providing dual-band operation, with minimal coupling between the frequency bands.

16 Claims, 14 Drawing Sheets

DUAL-BAND COUPLED SEGMENT HELICAL ANTENNA

RELATED APPLICATIONS

This application is related to a commonly owned patent application Ser. No. 08/690,023 filed on even date herewith and entitled "Bent-Segment Helical Antenna" and a second patent application Ser. No. 08/640298, entitled "Coupled Multi-Segment Helical Antenna," filed on Apr. 30, 1996. The full disclosure of each of these applications is incorporated herein by reference as if reproduced in full below.

BACKGROUND OF THE INVENTION

I. Field of the Invention

This invention relates generally to helical antennas and more specifically to a dual-band helical antenna having coupled radiator segments.

II. Field of the Invention

Contemporary personal communication devices are enjoying widespread use in numerous mobile and portable applications. With traditional mobile applications, the desire to minimize the size of the communication device, such as a mobile telephone for example, led to a moderate level of downsizing. However, as the portable, hand-held applications increase in popularity, the demand for smaller and smaller devices increases dramatically. Recent developments in processor technology, battery technology and communications technology have enabled the size and weight of the portable device to be reduced drastically over the past several years.

One area in which reductions in size are desired is the device's antenna. The size and weight of the antenna play an important role in downsizing the communication device. The overall size of the antenna can impact the size of the device's body. Smaller diameter and shorter length antennas can allow smaller overall device sizes as well as smaller body sizes.

Size of the device is not the only factor that needs to be considered in designing antennas for portable applications. Another factor to be considered in designing antennas is attenuation and/or blockage effects resulting from the proximity of the user's head to the antenna during normal operations. Yet another factor is the characteristics of the communication link, such as, for example, desired radiation patterns and operating frequencies.

An antenna that finds widespread usage in satellite communication systems is the helical antenna. One reason for the helical antenna's popularity in satellite communication systems is its ability to produce and receive circularly-polarized radiation employed in such systems. Additionally, because the helical antenna is capable of producing a radiation pattern that is nearly hemispherical, the helical antenna is particularly well suited to applications in mobile satellite communication systems and in satellite navigational systems.

Conventional helical antennas are made by twisting the radiators of the antenna into a helical structure. A common helical antenna is the quadrifilar helical antenna which utilizes four radiators spaced equally around a core and excited in phase quadrature (i.e., the radiators are excited by signals that differ in phase by ¼ of a period or 90°). The length of the radiators is typically an integer multiple of the quarter wavelength of the operating frequency of the communication device. The radiation patterns are typically adjusted by varying the pitch of the radiator, the length of the radiator (in integer multiples of a quarter-wavelength), and the diameter of the core.

Conventional helical antennas can be made using wire or strip technology. With strip technology, the radiators of the antenna are etched or deposited onto a thin, flexible substrate. The radiators are positioned such that they are parallel to each other, but at an obtuse angle to the sides of the substrate. The substrate is then formed, or rolled, into a cylindrical, conical, or other appropriate shape causing the strip radiators to form a helix.

This conventional helical antenna, however, also has the characteristic that the radiators are an integer multiple of one quarter wavelength of the desired resonant frequency, resulting in an overall antenna length that is longer than desired for some portable or mobile applications.

Additionally, in applications where transmit and receive communications occur at different frequencies, dual-band antennas are desirable. However, dual-band antennas are often available only in less than desirable configurations. For example, one way in which a dual band antenna can be made is to stack two single-band quadrifilar helix antennas end-to-end, so that they form a single cylinder. A disadvantage of this solution, however, is that such an antenna is longer than would otherwise be desired for portable, or hand-held applications. Another technique for providing dual-band performance has been to utilize two separate single band antennas. However, for hand-held units, the two antennas would have to be located in close proximity to one another. Two single band antennas, placed in close proximity on a portable, or hand-held unit would cause coupling between the two antennas, leading to degraded performance as well as unwanted interference.

SUMMARY OF THE INVENTION

The present invention is a novel and improved dual-band helical antenna having two sets of one or more helically wound radiators. The radiators are wound such that the antenna is in a cylindrical, conical, or other appropriate shape to optimize or otherwise obtain desired radiation patterns. According to the invention, one set of radiators is provided for operation at a first frequency and the second set is provided for operation at a second frequency which is different from the first frequency.

In the first set of one or more radiators, each radiator is comprised of two radiator segments. One radiator segment extends in a helical fashion from one end of a radiator portion of the antenna toward the other end of the radiator portion. A second radiator segment extends in a helical fashion from the first end of the radiator portion toward the second end of the radiator portion. This second radiator segment is preferably U-shaped. The term "U-shape" is used in this document to refer to a U-shape, v-shape, hairpin shape, horseshoe shape, or other similar shape.

As a result of this structure, electromagnetic energy from the first segment of a radiator in the first set is coupled into the second segment of that radiator. The effective electrical length of these combined segments causes the radiator in the first set of one or more radiators to resonate at a given frequency. Because the segments are physically separate but electromagnetically coupled to one another, the length at which the radiator resonates for a given frequency can be made shorter than that of a conventional helical antenna radiator.

In the second set of one or more radiators, each radiator is positioned such that it is surrounded by the U-shaped segment. This has the effect of shielding, or electromagnetically isolating, the radiator in the first set from the first segment of the radiator in the first set.

One advantage of the invention is that for a given operating frequency, the first set of radiators can be made to resonate at a shorter physical length and/or in a smaller volume than a conventional helical antenna radiator with the same effective resonant length. Thus, the size of the antenna required for operation at the first frequency is smaller than that of conventional antennas.

Another advantage of the dual-band coupled segment helical antenna is that the second set of one or more radiators for operation at the second frequency are provided without increasing the overall length of a the antenna. This is because the second set of one or more radiators is interleaved with the one or more coupled segment radiators in the first set.

Another advantage of the coupled multi-segment helical antenna is that it can be easily tuned to a given frequency by adjusting or trimming the length of the radiator segments in the first set of radiators or by adjusting the length of the one or more radiators in the second set. Because the one or more radiators in the first set are not a single contiguous length, but instead are made up of a set of two or more overlapping segments, the length of the segments can easily be modified after the antenna has been made to properly tune the frequency of the antenna by trimming the radiators. Additionally, the overall radiation pattern of the antenna is essentially unchanged by the tuning because the overall physical length of the radiator portion of the antenna is unchanged by the trimming.

Yet another advantage of the invention is that its directional characteristics can be adjusted to maximize signal strength in a preferred direction, such as along the axis of the antenna. Thus for certain applications, such as satellite communications for example, the directional characteristics of the antenna can be optimized to maximize signal strength in the upward direction, away from the ground.

Further features and advantages of the present invention, as well as the structure and operation of various embodiments of the present invention, are described in detail below with reference to the accompanying drawings.

BRIEF DESCRIPTION OF THE DRAWINGS

The features, objects, and advantages of the present invention will become more apparent from the detailed description set forth below when taken in conjunction with the drawings in which like reference characters identify corresponding elements throughout and wherein.

DETAILED DESCRIPTION OF THE PREFERRED EMBODIMENTS

I. Overview and Discussion of the Invention

The present invention is directed toward a helical antenna having coupled multi-segment radiators to shorten the length of the radiators for a given resonant frequency, thereby reducing the overall length of the antenna. The manner in which this is accomplished is described in detail below according to several embodiments.

II. Example Environment

In a broad sense, the invention can be implemented in any system for which helical antenna technology can be utilized. One example of such an environment is a communication system in which users having fixed, mobile and/or portable telephones communicate with other parties through a satellite communication link. In this example environment, the telephone is required to have an antenna tuned to the frequency of the satellite communication link.

The present invention is described in terms of this example environment. Description in these terms is provided for convenience only. It is not intended that the invention be limited to application in this example environment. In fact, after reading the following description, it will become apparent to a person skilled in the relevant art how to implement the invention in alternative environments.

III. Conventional Helical Antennas

Figure 1A:
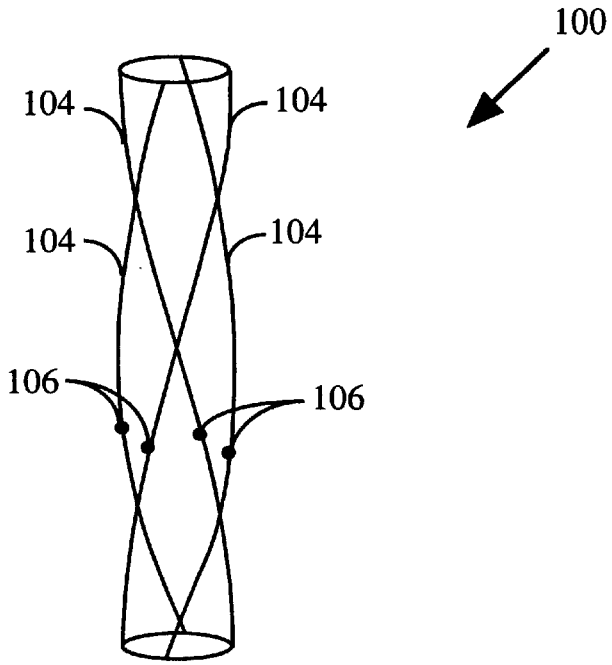
FIG. 1A is a diagram illustrating a conventional wire quadrifilar helical antenna.
Figure 1B:
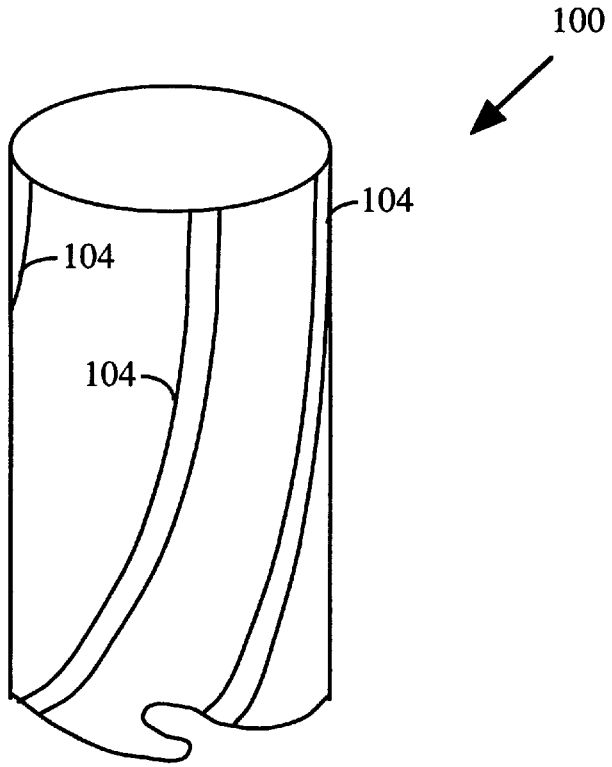
FIG. 1B is a diagram illustrating a conventional strip quadrifilar helical antenna.

Before describing the invention in detail, it is useful to describe the radiator portions of some conventional helical antennas. Specifically, this section of the document describes radiator portions of some conventional quadrifilar helical antennas. FIGS. 1A and 1B are diagrams illustrating a radiator portion 100 of a conventional quadrifilar helical antenna in wire form and in strip form, respectively. The radiator portion 100 illustrated in FIGS. 1A and 1B is that of a quadrifilar helical antenna, meaning it has four radiators 104 operating in phase quadrature. As illustrated in FIGS. 1A and 1B, radiators 104 are wound to provide circular polarization. Possible signal feed points 106 are shown for the radiators in FIG. 1B.

Figure 2A:
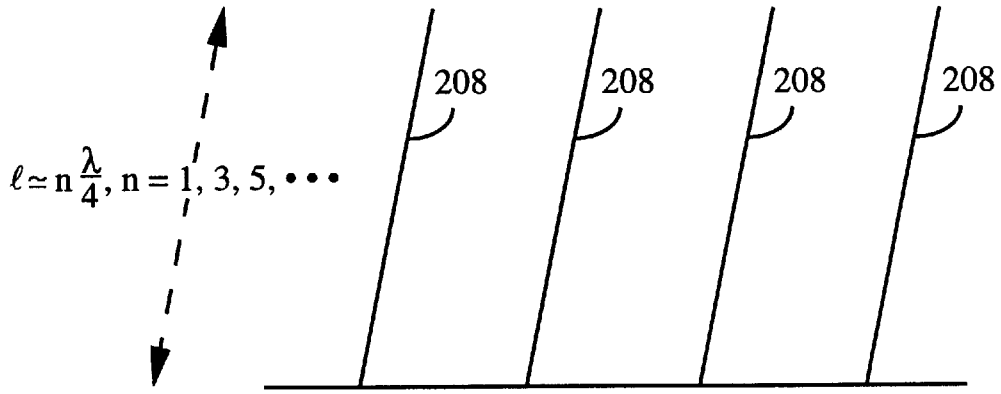
FIG. 2A is a diagram illustrating a planar representation of an open-circuited quadrifilar helical antenna.
Figure 2B:
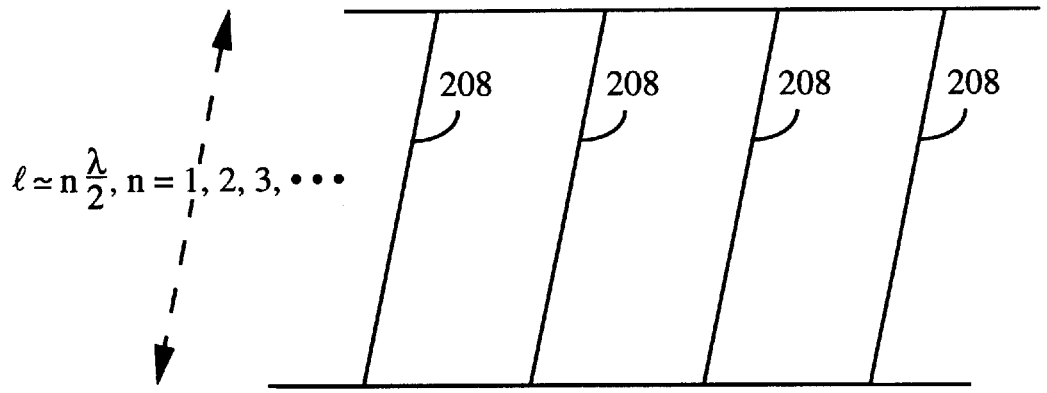
FIG. 2B is a diagram illustrating a planar representation of a short-circuited quadrifilar helical antenna.

FIGS. 2A and 2B are diagrams illustrating planar representations of a radiator portion of conventional quadrifilar helical antennas. In other words, FIGS. 2A and 2B illustrate the radiators as they would appear if the antenna cylinder were "unrolled" on a flat surface. FIG. 2A is a diagram illustrating a quadrifilar helical antenna which is open-circuited at the far end. For such a configuration, the resonant length l of the radiators 208 is an odd integer multiple of a quarter-wavelength of the desired resonant frequency.

FIG. 2B is a diagram illustrating a quadrifilar helical antenna which is short-circuited at the far end. In this case the resonant length l of radiators 208 is an even integer multiple of a quarter wavelength of the desired resonant frequency. Note that in both cases, the stated resonant length l is approximate, because a small adjustment is usually needed to compensate for non-ideal short and open terminations.

Figure 3:
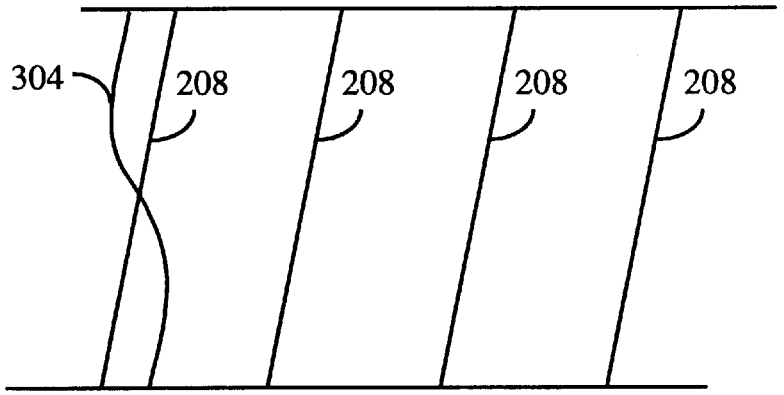
FIG. 3 is a diagram illustrating current distribution on a radiator of a short-circuited quadrifilar helical antenna.

FIG. 3 is a diagram illustrating a planar representation of a radiator portion of a quadrifilar helical antenna 300, which includes radiators 208 having a length $l=\lambda/2$, where $\lambda$ is the wavelength of the desired resonant frequency of the antenna. Curve 304 represents a current of a signal on a radiator 208 that resonates at a frequency of $f=\upsilon/\lambda$, where $\upsilon$ is the velocity of the signal in the medium.

Exemplary implementations of a quadrifilar helical antenna implemented using printed circuit board techniques (a strip antenna) are described in more detail with reference to FIGS. 4–6. The strip quadrifilar helical antenna is comprised of strip radiators 104 etched onto a dielectric substrate 406. The substrate is a thin flexible material that is rolled into a cylindrical shape such that radiators 104 are helically wound about a central axis of the cylinder.

Figure 5:
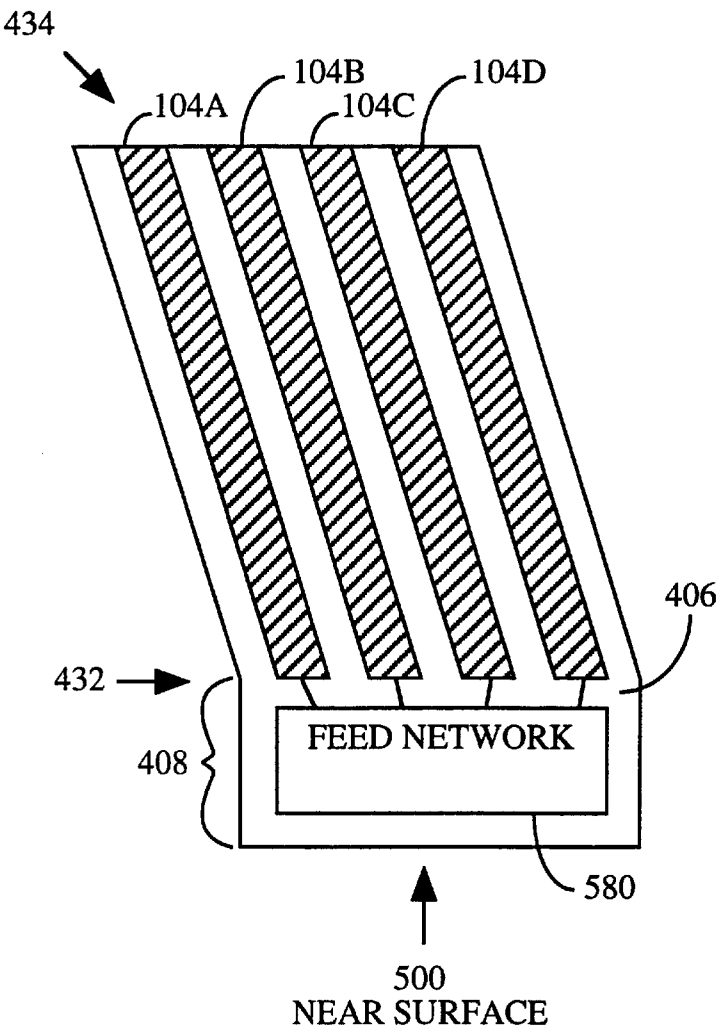
FIG. 5 is a diagram illustrating a near surface of an etched substrate of a strip helical antenna.
Figure 4:
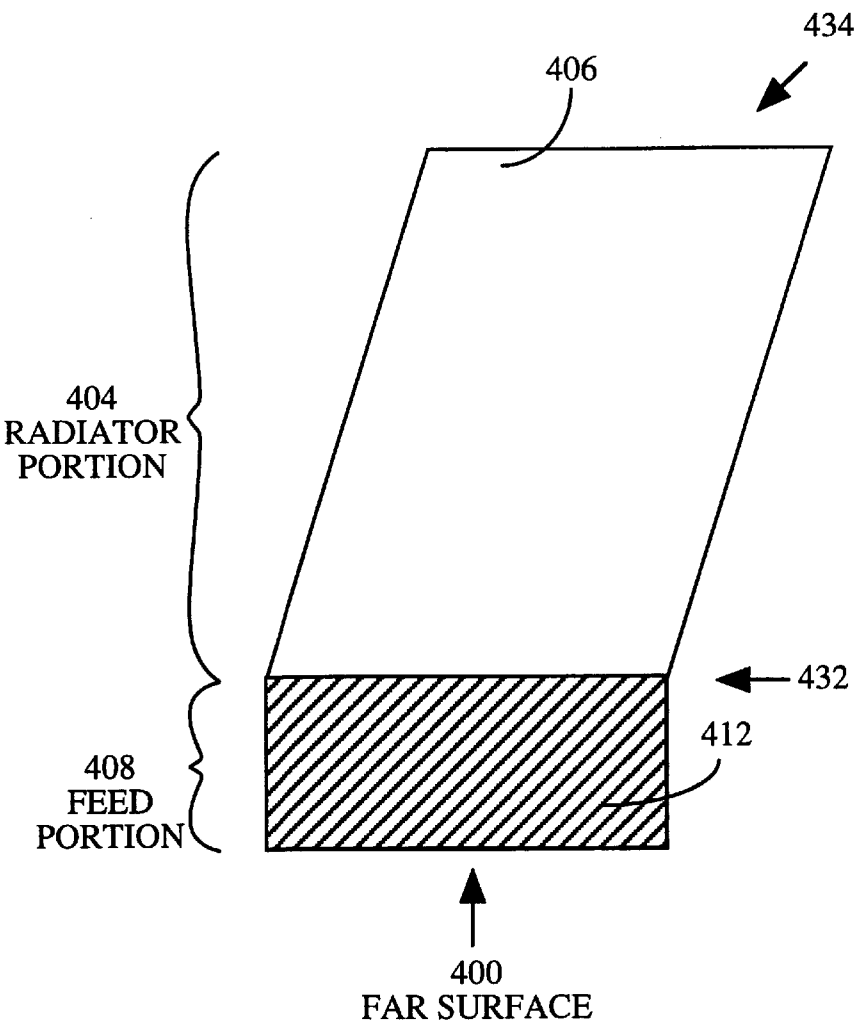
FIG. 4 is a diagram illustrating a far surface of an etched substrate of a strip helical antenna.
Figure 6:
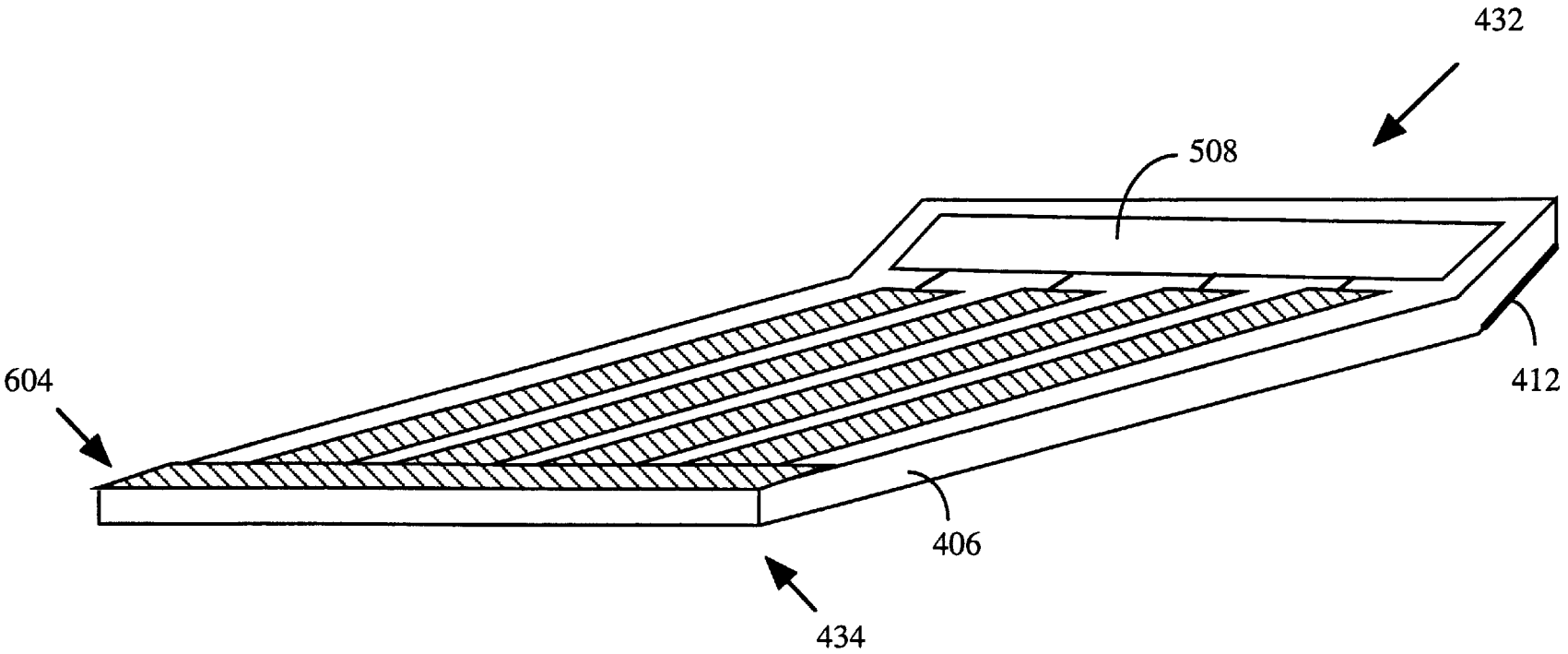
FIG. 6 is a diagram illustrating a perspective view of an etched substrate of a strip helical antenna.

FIGS. 4–6 illustrate the components used to fabricate a quadrifilar helical antenna 100. FIGS. 4 and 5 present a view of a far surface 400 and near surface 500 of substrate 406, respectively. The antenna 100 includes a radiator portion 404, and a feed portion 408.

In the embodiments described and illustrated herein, the antennas are described as being made by forming the substrate into a cylindrical shape with the near surface being on the outer surface of the formed cylinder. In alternative embodiments, the substrate is formed into the cylindrical shape with the far surface being on the outer surface of the cylinder.

In one embodiment, dielectric substrate 100 is a thin, flexible layer of polytetraflouroethalene (PTFE), a PTFE/glass composite, or other dielectric material. In one embodiment, substrate 406 is on the order of 0.005 in., or 0.13 mm thick, although other thicknesses can be chosen. Signal traces and ground traces are provided using copper. In alternative embodiments, other conducting materials can be chosen in place of copper depending on cost, environmental considerations and other factors.

In the embodiment illustrated in FIG. 5, feed network 508 is etched onto feed portion 408 to provide the quadrature phase signals (i.e., the 0°, 90°, 180° and 270° signals) that are provided to radiators 104. Feed portion 408 of far surface 400 provides a ground plane 412 for feed circuit 508. Signal traces for feed circuit 508 are etched onto near surface 500 of feed portion 408.

For purposes of discussion, radiator portion 404 has a first end 432 adjacent to feed portion 408 and a second end 434 (on the opposite end of radiator portion 404). Depending on the antenna embodiment implemented, radiators 104 can be etched into far surface 400 of radiator portion 404. The length at which radiators 104 extend from first end 432 toward second end 434 is approximately an integer multiple of a quarter wavelength of the desired resonant frequency.

In such an embodiment where radiators 104 are an integer multiple of $\lambda/2$, radiators 104 are electrically connected (i.e., short circuited) at second end 434. This connection can be made by a conductor across second end 434 which forms a ring 604 around the circumference of the antenna when the substrate is formed into a cylinder. FIG. 6 is a diagram illustrating a perspective view of an etched substrate of a strip helical antenna having a shorting ring 604 at second end 434.

One conventional quadrifilar helical antenna is described in U.S. Pat. No. 5,198,831 to Burrell, et. al. (referred to as the '831 patent), which is incorporated herein by reference. The antenna described in the '831 patent is a printed circuit-board antenna having the antenna radiators etched or otherwise deposited on a dielectric substrate. The substrate is formed into a cylinder resulting in a helical configuration of the radiators.

Another conventional quadrifilar helical antenna is disclosed in U.S. Pat. No. 5,255,005 to Terret et al (referred to as the '005 patent) which is incorporated herein by reference. The antenna described in the '005 patent is a quadrifilar helical antenna formed by two bifilar helices positioned orthogonally and excited in phase quadrature. The disclosed antenna also has a second quadrifilar helix that is coaxial and electromagnetically coupled with the first helix to improve the passband of the antenna.

Yet another conventional quadrifilar helical antenna is disclosed in U.S. Pat. No. 5,349,365, to Ow et al (referred to as the '365 patent) which is incorporated herein by reference. The antenna described in the '365 patent is a quadrifilar helical antenna designed in wireform as described above with reference to FIG. 1A.

IV. Coupled Multi-Segment Helical Antenna

One variation of the conventional helical antenna is a coupled multi-segment helical antenna which is now described in terms of several embodiments. In order to reduce the length of radiator portion 100 of the antenna, this variation utilizes coupled multi-segment radiators that allow for resonance at a given frequency at shorter lengths than would otherwise be needed for a conventional helical antenna with an equivalent resonant length.

Figure 7A:
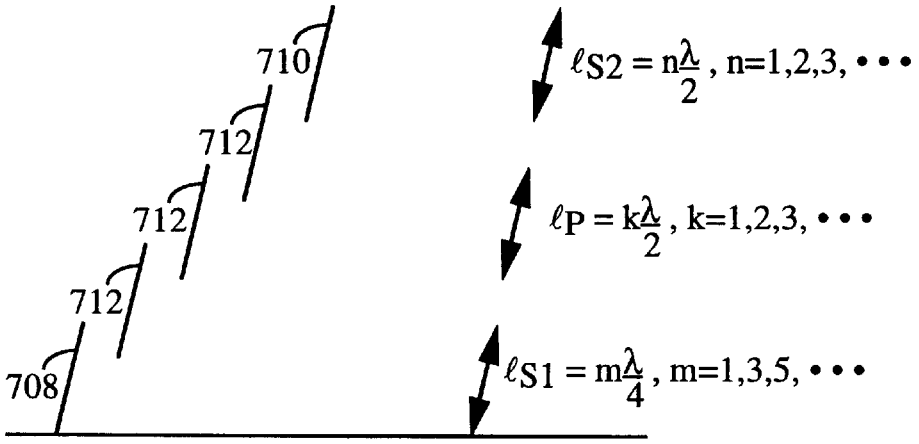
FIG. 7A is a diagram illustrating an open-circuit coupled multi-segment radiator having five coupled segments.
Figure 7B:
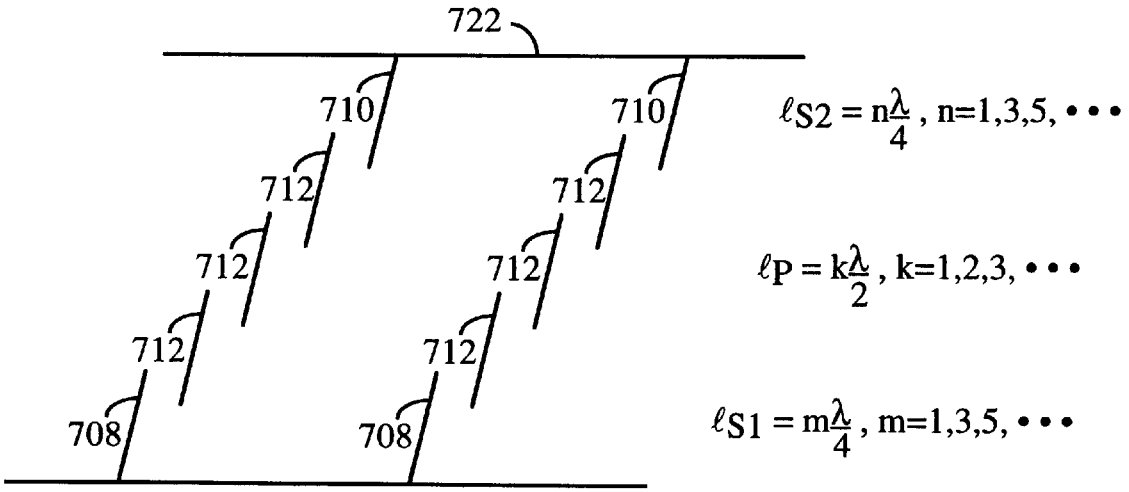
FIG. 7B is a diagram illustrating a pair of short-circuited coupled multi-segment radiators.

FIGS. 7A and 7B are diagrams illustrating planar representations of example embodiments of coupled-segment helical antennas. FIG. 7A illustrates a coupled multi-segment radiator 706 terminated in an open-circuit according to one single-filar embodiment. An antenna terminated in an open-circuit such as this may be used in a single-filar, bifilar, quadrifilar, or other x-filar implementation.

The embodiment illustrated in FIG. 7A is comprised of a single radiator 706. Radiator 706 is comprised of a set of radiator segments. This set is comprised of two end segments 708, 710 and p intermediate segments 712, where p=0, 1, 2, 3 . . . (the case where p=3 is illustrated). Intermediate segments are optional (i.e., p can equal zero). End segments 708, 710 are physically separate from but electromagnetically coupled to one another. Intermediate segments 712 are positioned between end segments 708, 710 and provide electromagnetic coupling between end segments 708, 710.

In the open-circuited embodiment, the length $l_{s1}$ of segment 708 is an odd-integer multiple of one-quarter wavelength of the desired resonant frequency. The length $l_{s2}$ of segment 710 is an integer multiple of one-half the wavelength of the desired resonant frequency. The length $l_p$ of each of the p intermediate segments 712 is an integer multiple of one-half the wavelength of the desired resonant frequency. In the embodiment illustrated there are three intermediate segments 712 (i.e., p=3).

FIG. 7B illustrates radiators 706 of the helical antenna when terminated in a short-circuit 722. This short-circuited implementation is not suitable for a single-filar antenna, but can be used for bifilar, quadrifilar or other x-filar antennas. As with the open-circuited embodiment, radiators 706 are comprised of a set of radiator segments. This set is comprised of two end segments 708, 710 and p intermediate segments 712, where p=0, 1, 2, 3 . . . (the case where p=3 is illustrated). Intermediate segments are optional (i.e., p can equal zero). End segments 708, 710 are physically separate from but electromagnetically coupled to one another. Intermediate segments 712 are positioned between end segments 708, 710 and provide electromagnetic coupling between end segments 708, 710.

In the short-circuited embodiment, the length $l_{s1}$ of segment 708 is an odd-integer multiple of one-quarter wavelength of the desired resonant frequency. The length $l_{s2}$ of segment 710 is an odd-integer multiple of one-quarter wavelength of the desired resonant frequency. The length $l_p$ of each of the p intermediate segments 712 is an integer multiple of one-half the wavelength of the desired resonant frequency. In the embodiment illustrated there are three intermediate segments 712 (i.e., p=3).

Figure 8A:
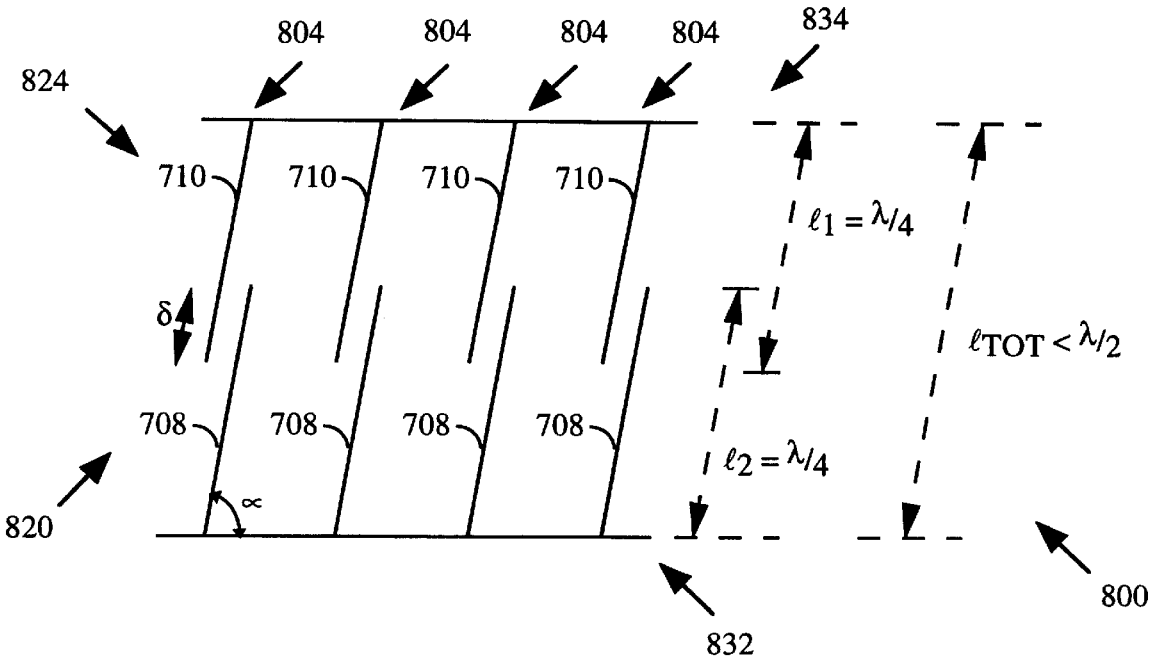
FIG. 8A is a diagram illustrating a planar representation of a short-circuited coupled multi-segment quadrifilar helical antenna.
Figure 8B:
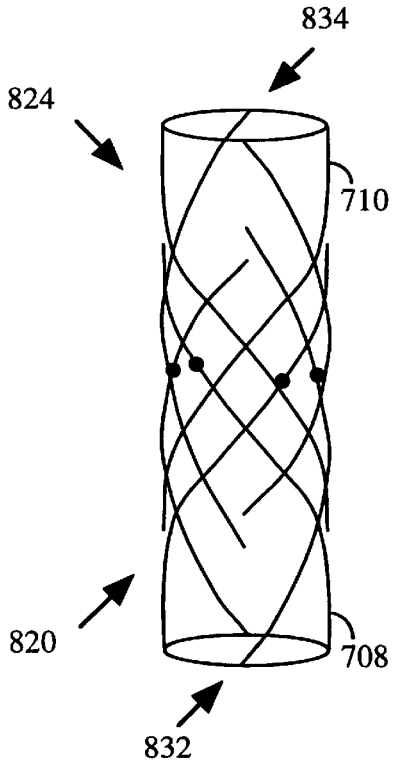
FIG. 8B is a diagram illustrating a coupled multi-segment quadrifilar helical antenna formed into a cylindrical shape.

FIGS. 8A and 8B are diagrams illustrating one embodiment of a coupled multi-segment quadrifilar helical antenna radiator portion 800. FIGS. 8A and 8B illustrate one example implementation of the antenna illustrated in FIG. 7B, where p=zero (i.e., there are no intermediate segments 712) and the lengths of segments 708, 710 are one-quarter wavelength.

The radiator portion 800 illustrated in FIG. 8A is a planar representation of a quadrifilar helical antenna, having four coupled radiators 804. Each coupled radiator 804 in the coupled antenna is actually comprised of two radiator segments 708, 710 positioned in close proximity with one another such that the energy in radiator segment 708 is coupled to the other radiator segment 710.

More specifically, according to one embodiment, radiator portion 800 can be described in terms of having two sections 820, 824. Section 820 is comprised of a plurality of radiator segments 708 extending from a first end 832 of the radiator portion 800 toward the second end 834 of radiator portion 800. Section 824 is comprised of a second plurality of radiator segments 710 extending from second end 834 of the radiator portion 800 toward first end 832. Toward the center area of radiator portion 800, a part of each segment 708 is in close proximity to an adjacent segment 710 such that energy from one segment is coupled into the adjacent segment in the area of proximity. This is referred to in this document as overlap.

In one embodiment, each segment 708, 710 is of a length of approximately $l_1=l_2=\lambda/4$. The overall length of a single radiator comprising two segments 708, 710 is defined as $l_{tot}$. The amount one segment 708 overlaps another segment 710 is defined as $\delta=l_1+l_2-l_{tot}$.

For a resonant frequency $f=\upsilon/\lambda$ the overall length of a radiator $l_{tot}$ is less than the half-wavelength length of $\lambda/2$. In other words, as a result of coupling, a radiator, comprising a pair of coupled segments 708, 710, resonates at frequency $f=\upsilon/\lambda$ even though the overall length of that radiator is less than a length of $\lambda/2$. Therefore, the radiator portion 800 of a half-wavelength coupled multi-segment quadrifilar helical antenna is shorter than the radiator portion of conventional half-wavelength quadrifilar helical antenna 800 for a given frequency f.

For a clearer illustration of the reduction in size gained by using the coupled configuration, compare the radiator portions 800 illustrated in FIG. 8 with those illustrated in FIG. 3. For a given frequency $f=\upsilon/\lambda$, the length l of radiator portion 300 of the conventional antenna is $\lambda/2$, while the length $l_{tot}$ of radiator portion 800 of the coupled radiator segment antenna is $<\lambda/2$.

As stated above, in one embodiment, segments 708, 710 are of a length $l_1=l_2=\lambda/4$. The length of each segment can be varied such that $l_1$ is not necessarily equal to $l_2$, and such that they are not equal to $\lambda/4$. The actual resonant frequency of each radiator is a function of the length of radiator segments 708, 710 the separation distance s between radiator segments 708, 710 and the amount which segments 708, 710 overlap each other.

Note that changing the length of one segment 708 with respect to the other segment 710 can be used to adjust the bandwidth of the antenna. For example, lengthening $l_1$ such that it is slightly greater than $\lambda/4$ and shortening $l_2$ such that it is slightly shorter than $\lambda/4$ can increase the bandwidth of the antenna. FIG. 8B illustrates the actual helical configuration of a coupled multi-segment quadrifilar helical antenna according to one embodiment of the invention. This illustrates how each radiator is comprised of two segments 708, 710 in one embodiment. Segment 708 extends in a helical fashion from first end 832 of the radiator portion toward second end 834 of the radiator portion. Segment 710 extends in a helical fashion from second end 834 of the radiator portion toward first end 832 of the radiator portion. FIG. 8B further illustrates that a portion of segments 708, 710 overlap such that they are electromagnetically coupled to one another.

Figure 9A:
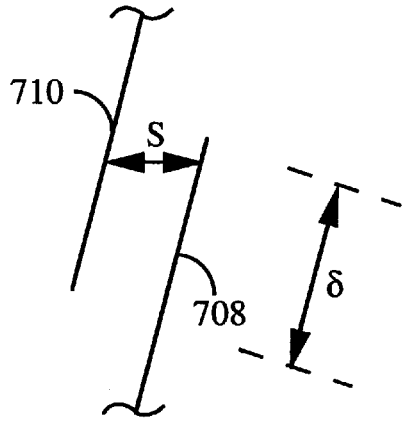
FIG. 9A is a diagram illustrating overlap $\delta$ and spacing s of radiator segments according to one embodiment of the invention.

FIG. 9A is a diagram illustrating the separation s and overlap δ between radiator segments 708, 710. Separation s is chosen such that a sufficient amount of energy is coupled between the radiator segments 708, 710 to allow them to function as a single radiator of an effective electrical length of approximately $\lambda/2$ and integer multiples thereof.

Spacing of radiator segments 708, 710 closer than this optimum spacing results in greater coupling between segments 708, 710. As a result, for a given frequency f the length of segments 708, 710 must increase to enable resonance at the same frequency f. This can be illustrated by the extreme case of segments 708, 710 being physically connected (i.e., s=0). In this extreme case, the total length of segments 708, 710 must equal $\lambda/2$ for the antenna to resonate. Note that in this extreme case, the antenna is no really 'coupled' according to the usage of the term in this specification, and the resulting configuration is actually that of a conventional helical antenna such as that illustrated in FIG. 3.

Similarly, increasing the amount of overlap $\delta$ of segments 708, 710 increases the coupling. Thus, as overlap $\delta$ increases, the length of segments 708, 710 increases as well.

Figure 9B:
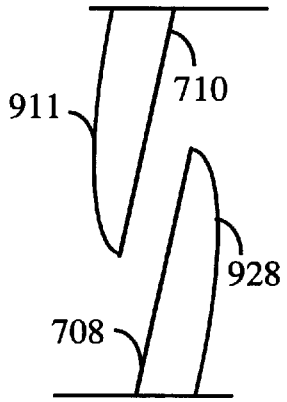
FIG. 9B is a diagram illustrating example current distributions on radiator segments of the coupled multi-segment helical antenna.

To qualitatively understand the optimum overlap and spacing for segments 708, 710, refer to FIG. 9B. FIG. 9B represents a magnitude of the current on each segment 708, 710. Current strength indicators 911, 928 illustrate that each segment ideally resonates at $\lambda/4$, with the maximum signal strength at the outer ends and the minimum at the inner ends.

To optimize antenna configurations for the coupled radiator segment antenna, the inventor utilized modeling software to determine correct segment length $l_1$, $l_2$, overlap $\delta$, and spacing s among other parameters. One such software package is the Antenna Optimizer (AO) software package. AO is based on a method of moments electromagnetic modeling algorithm. AO Antenna Optimizer version 6.35, copyright 1994, was written by and is available from Brian Beezley, of San Diego, Calif.

Note that there are certain advantages obtained by using a coupled configuration as described above with reference to FIGS. 8A and 8B. With both the conventional antenna and the coupled radiator segment antenna, current is concentrated at the ends of the radiators. Pursuant to array factor theory, this can be used to an advantage with the coupled radiator segment antenna in certain applications.

Figure 10A:
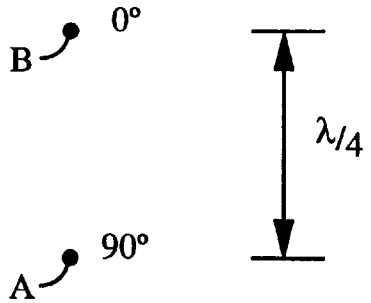
FIG. 10A is a diagram illustrating two point sources radiating signals differing in phase by 90°.
Figure 10B:
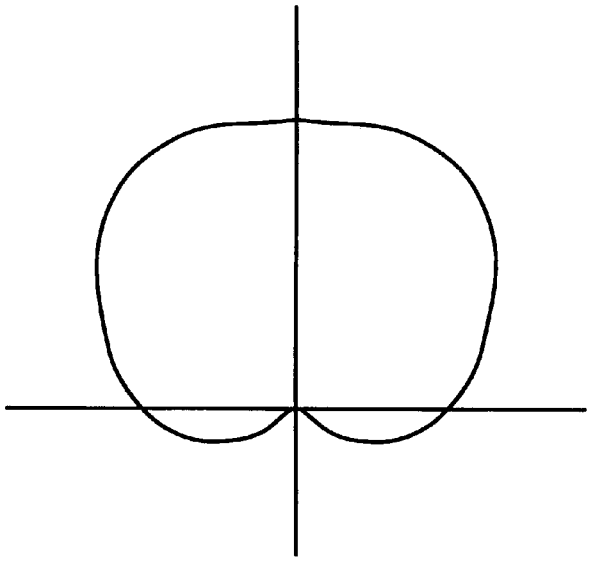
FIG. 10B is a diagram illustrating field patterns for the point sources illustrated in FIG. 10A.

To explain, FIG. 10A is a diagram illustrating two point sources, A, B, where source A is radiating a signal having a magnitude equal to that of the signal of source B but lagging in phase by 90° (the $e^{jwt}$ convention is assumed). Where sources A and B are separated by a distance of $\lambda/4$, the signals add in phase in the direction traveling from A to B and add out of phase in the direction from B to A. As a result, very little radiation is emitted in the direction from B to A. A typical representative field pattern shown in FIG. 10B illustrates this point.

Thus, when the sources A and B are oriented such that the direction from A to B points upward, away from the ground, and the direction from B to A points to the ground, the antenna is optimized for most applications. This is because it is rare that a user desires an antenna that directs signal strength toward the ground. This configuration is especially useful for satellite communications where it is desired that the majority of the signal strength be directed upward, away from the ground.

The point source antenna modeled in FIG. 10A is not readily achievable using conventional half wavelength helical antennas. Consider the antenna radiator portion illustrated in FIG. 3. The concentration of current strength at the ends of radiators 208 roughly approximates a point source. When radiators are twisted into a helical configuration, one end of the 90° radiator is positioned in line with the other end of the 0° radiator. Thus, this approximates two point sources in a line. However, these approximate point sources are separated by approximately $\lambda/2$ as opposed to the desired $\lambda/4$ configuration illustrated in FIG. 10A.

Note, however that the coupled radiator segment antenna according to the invention provides an implementation where the approximated point sources are spaced at a distance closer to $\lambda/4$. Therefore, the coupled radiator segment antenna allows users to capitalize on the directional characteristics of the antenna illustrated in FIG. 10A.

The radiator segments 708, 710 illustrated in FIG. 8 show that segment 708 is very near its associated segment 710, yet each pair of segments 708, 710 is relatively far from the adjacent pair of segments. In one alternative embodiment, each segment 710 is placed equidistant from the segments 708 on either side. This embodiment is illustrated in FIG. 11.

Figure 11:
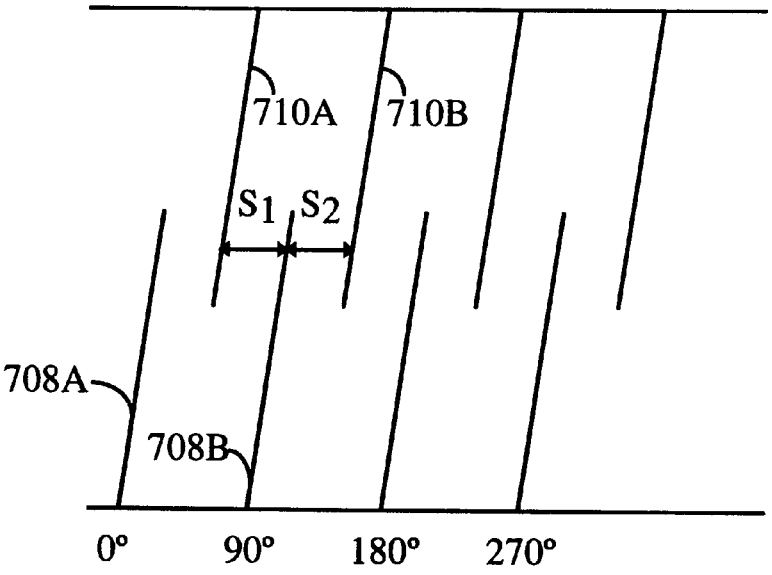
FIG. 11 is a diagram illustrating the embodiment in which each segment is placed equidistant from the segments on either side.

Referring now to FIG. 11, each segment is substantially equidistant from each pair of adjacent segments. For example, segment 708B is equidistant from segments 710A, 710B. That is, $s_1=s_2$. Similarly, segment 710A is equidistant from segments 708A, 708B.

This embodiment is counterintuitive in that it appears as if unwanted coupling would exist. In other words, a segment corresponding to one phase would couple not only to the appropriate segment of the same phase, but also to the adjacent segment of the shifted phase. For example, segment 708B, the 90° segment would couple to segment 710A (the 0° segment) and to segment 710B (the 90° segment). Such coupling is not a problem because the radiation from the top segments 710 can be thought of as two separate modes. One mode resulting from coupling to adjacent segments to the left and the other mode from coupling to adjacent segments to the right. However, both of these modes are phased to provide radiation in the same direction. Therefore, this double-coupling is not detrimental to the operation of the coupled multi-segment antenna.

One additional advantage of the segmented radiator helical antenna is that it is very easy to tune the antenna after it has already been manufactured. The antenna can be simply tuned by trimming segments 708, 710. Note that if desired this can be done without changing the overall length of the antenna.

V. Dual-Band Coupled Segment Antenna

In some applications, it is desirable to have an antenna that operates at two frequencies. One example of such an application is a communication system operating at one frequency for transmit and a second frequency for receive. One conventional technique for achieving dual band performance is to stack two single-band quadrifilar helical antennas end-to-end to form a single long cylinder. For example, a system designer may stack an L-Band and an S-Band antenna to achieve operational characteristics at both L and S bands. Such stacking, however, increases the overall length of the antenna.

To reduce the overall length of the dual-band antenna, the inventors have developed a dual-band coupled segment antenna that does not require stacking of two helical antennas. The dual-band coupled segment antenna according to the invention effectively "overlays" two single band antennas over one another.

Figure 12A:
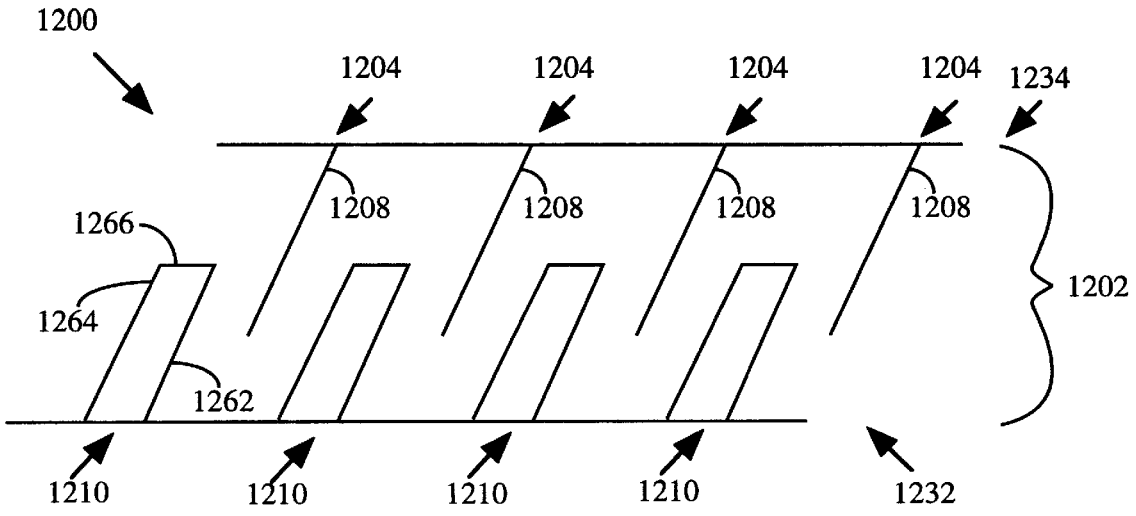
FIG. 12A is a diagram illustrating a planar representation of a coupled segment helical antenna wherein a segment of each radiator is U-shaped.

FIG. 12A is a diagram illustrating a planar representation of a quadrifilar single-band coupled multi-segment helical antenna 1200 having a U-shaped segment. In this embodiment, radiator 1204 is comprised of a straight segment 1208 and a U-shaped segment 1210 in a radiator portion 1202. Straight segment 1208 extends from a second end 1234 of radiator portion 1202 toward a first end 1232, while U-shaped segment 1210 extends from first end 1232 of radiator portion 1202 toward second end 1234. U-shaped segment 1210 can comprise a variety of different shapes that roughly approximate a "U" or other partially enclosed shape such as, for example, a hairpin, a horseshoe, or other similar shape.

In the embodiment illustrated, U-shaped segment 1210 can be described as having three sections: a first section 1262 extending from first end 1232 toward second end 1234, a second section 1264 that is adjacent to first section 1262 and a third section 1266 connecting the first and second sections 1262, 1264. Straight segment 1208 is in proximity with U-shaped segment 1210 such that the segments 1208, 1210 are physically separate from but electromagnetically coupled to each other. In the embodiment illustrated, the corners of U-shaped segment 1210 are relatively sharp. In alternative embodiments, the corners can be rounded, beveled, or of some other alternative shape.

Figure 12B:
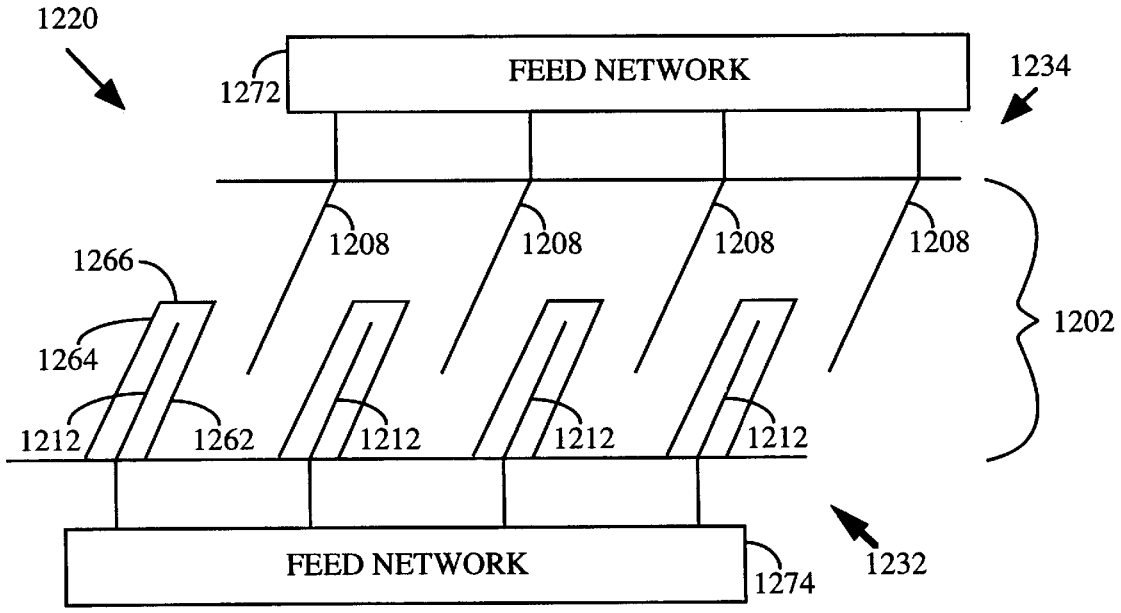
FIG. 12B is a diagram illustrating a planar representation of a dual-band coupled segment helical antenna according to one embodiment of the invention.

To achieve dual-band operation, a second single-band helical antenna is incorporated into the structure of single-band coupled multi-segment helical antenna 1200. The resultant dual-band coupled segment helical antenna 1220 is illustrated in FIG. 12B according to one embodiment. The embodiment illustrated in FIG. 12B is also a quadrifilar embodiment, although the dual-band antenna can be implemented in monofilar, bifilar and other x-filar embodiments.

FIG. 12B is a planar representation of a dual-band coupled segment helical antenna 1220 according to one embodiment of the invention. Antenna 1220 is comprised of two sets of radiators 1204, 1212 extending across a radiator portion 1202. Radiators 1204 and 1212 each resonate at a designated operational frequency, thus providing dual-band operation. Radiators 1204 are comprised of segments 1208, 1210 as described above with reference to FIG. 12A.

Radiators 1204 resonate at a first operational frequency $\upsilon/\lambda_1$. A feed network 1272 provides the quadrature phase signals (i.e., the 0°, 90°, 180° and 270° signals) of the first frequency $f_1=\upsilon/\lambda_1$ to radiators 1204.

Radiators 1212 are disposed within U-shaped segments 1210. Radiators 1212 resonate at a second operational frequency $\upsilon/\lambda_2$. A feed network 1274 provides the quadrature phase signals (i.e., the 0°, 90°, 180° and 270° signals) of the second frequency $f_2=\upsilon/\lambda_2$ to radiators 1212. Because U-shaped segments 1210 surround radiators 1212, U-shaped segments 1210 serve to isolate the two frequency bands.

Figure 13:
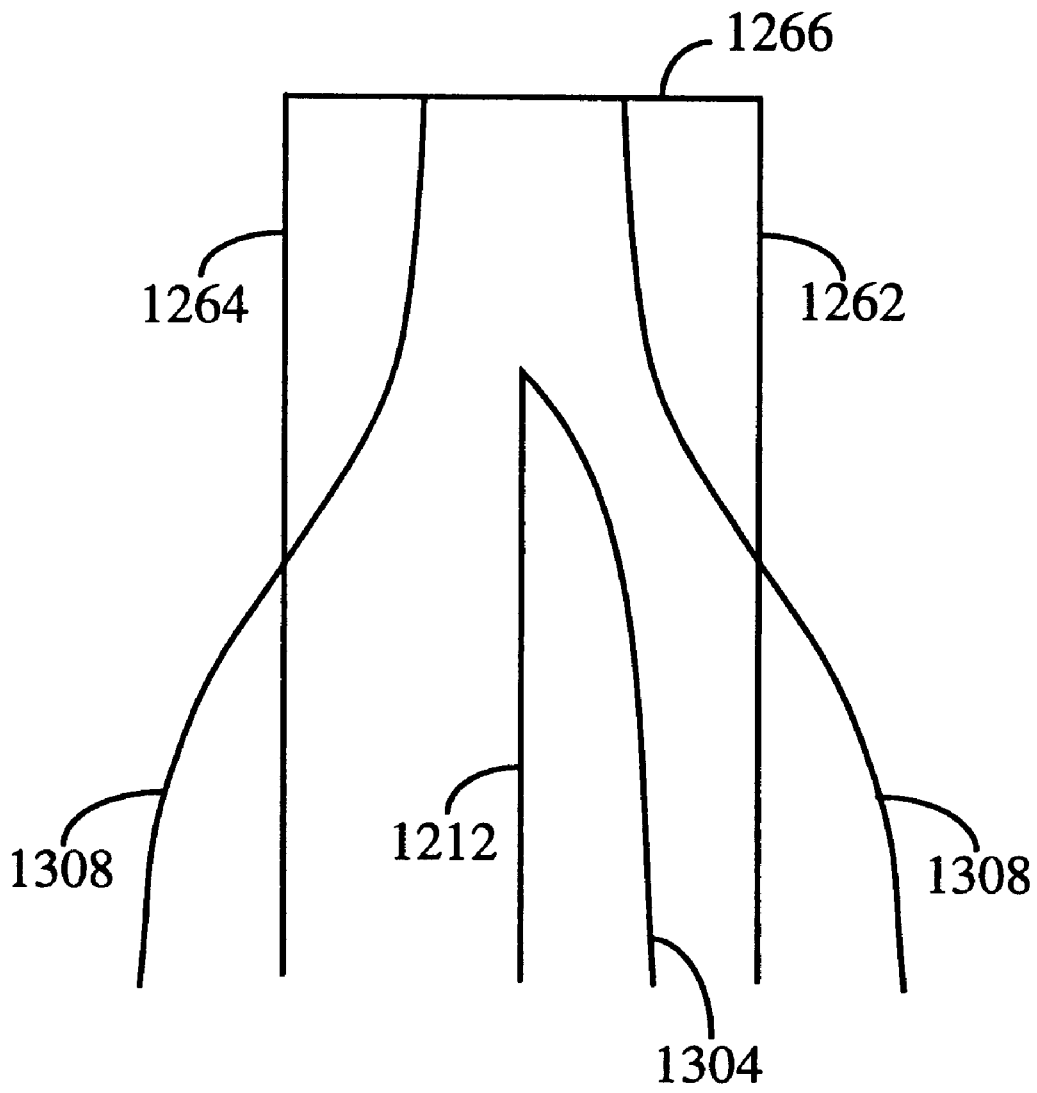
FIG. 13 is a diagram illustrating an example current distribution on a portion of a dual-band coupled segment helical antenna.

The structure and operation of dual-band coupled segment helical antenna 1220 is now described. FIG. 13 is a diagram illustrating current distribution on segment 1210 and radiator 1212. In the illustrated embodiment, radiator 1212 is $\lambda_2/4$ and is fed from first end 1232. Sections 1262, 1264, 1266 are a total of $\lambda_2$ in length. The current in radiator 1212 (illustrated by distribution curve 1304) is coupled into first section 1262. Because the total length of sections 1262, 1264, 1266 is $\lambda_2$, the standing wave is folded around segment 1210 as illustrated by current distribution curve 1308. Because the current on section 1262 is equal and opposite to the current on section 1264, these currents cancel on radiator 1208, effectively isolating the radiation of frequency $\upsilon/\lambda_1$ from frequency $\upsilon/\lambda_2$ In one embodiment, the dual-band coupled segment helical antenna 1220 is implemented using printed circuit board or other like techniques (a strip antenna). This embodiment is described in more detail with reference to FIGS. 14A and 14B. The strip embodiment dual-band coupled segment helical antenna is comprised of strip radiators 1204, 1212 etched onto a dielectric substrate. The substrate is a thin flexible material that is rolled into a cylindrical, conical or other appropriate shape such that the radiators are helically wound (preferably symmetrically) about a center axis of the shape.

Figure 14A:
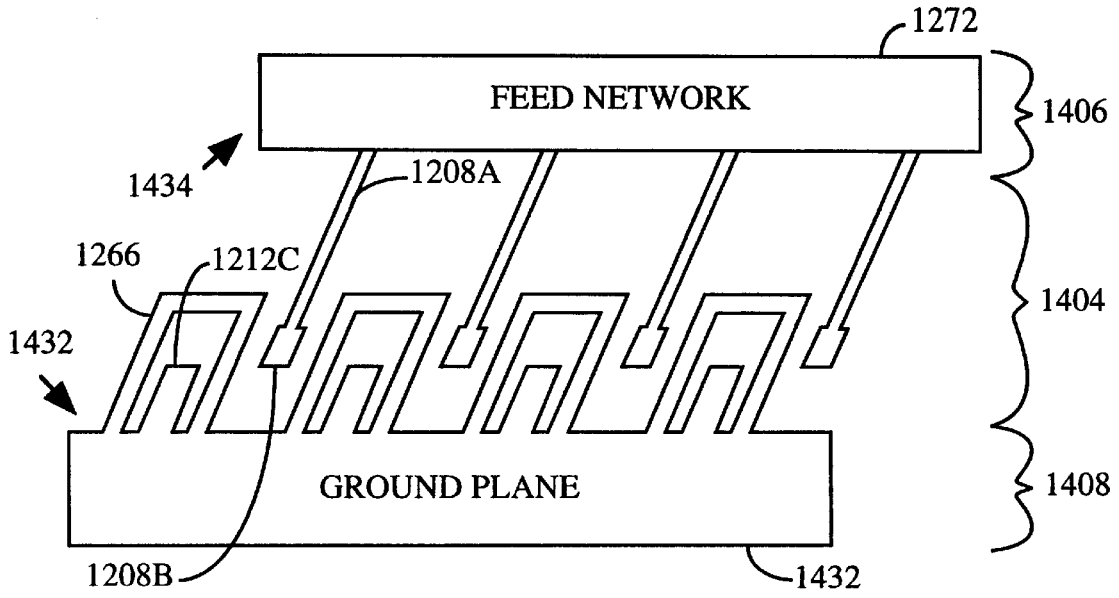
FIG. 14A is a diagram illustrating a far surface of a dual-band coupled segment helical antenna according to one embodiment of the invention.
Figure 14B:
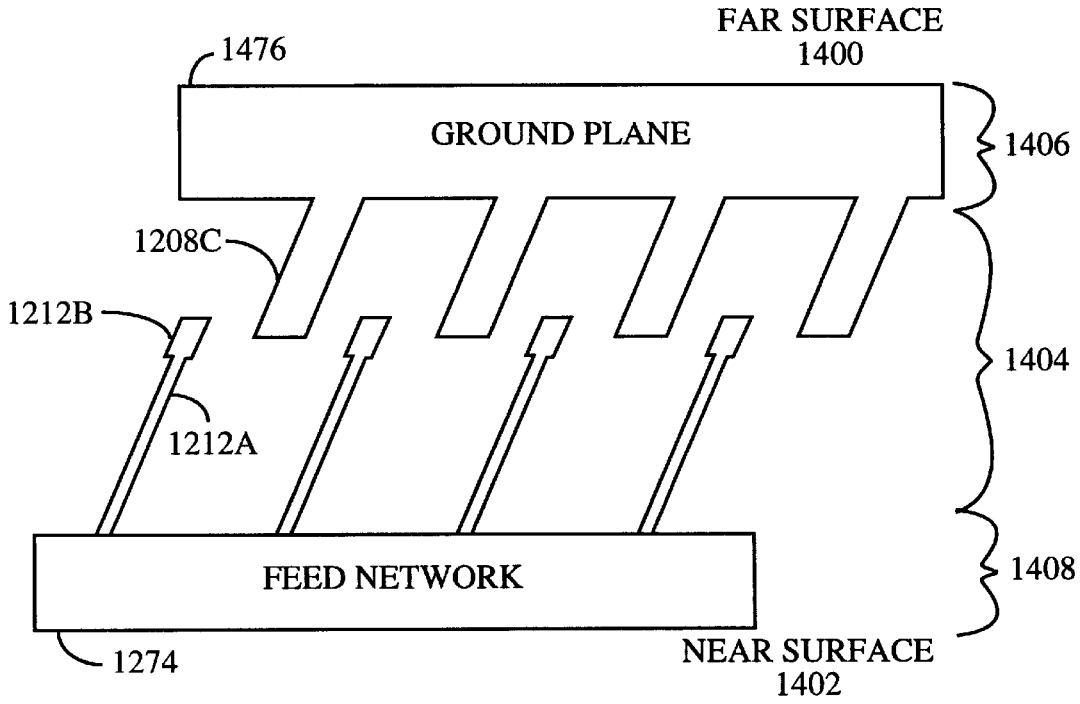
FIG. 14B is a diagram illustrating a near surface of a dual-band coupled segment helical antenna according to one embodiment of the invention.

FIGS. 14A and 14B illustrate the components used to fabricate a dual-band coupled segment helical antenna 1220. FIGS. 14A and 14B present a view of a far surface 1400 and near surface 1402 of a substrate, respectively. The dual-band coupled segment helical antenna 1220 includes a radiator portion 1404, a first feed portion 1406 and a second feed portion 1408. For purposes of discussion, radiator portion 1404 has a first end 1232 adjacent to feed portion 1408 and a second end 1434 adjacent to feed portion 1406 (on the opposite end of radiator portion 404).

In the embodiments described and illustrated herein, the antennas are described as being made by forming the substrate into a cylindrical, conical or other appropriate shape with the near surface being on the outer surface of the formed cylinder. In alternative embodiments, the substrate is formed into the appropriate shape with the far surface being on the outer surface of the shape.

In one embodiment, the dielectric substrate is a thin, flexible layer of polytetraflouroethalene (PTFE), a PTFE/glass composite, or other dielectric material as provided in conventional helical antennas described above.

In the embodiment illustrated in FIGS. 14A and 14B, feed network 1272 is etched onto feed portion 1406 on far surface 1400. That is, signal traces for feed network 1272 are etched onto far surface 1400 of feed portion 1406. A ground plane 1476 for feed network 1272 is provided on near surface 1402 of feed portion 1406. Feed network 1274 is etched onto feed portion 1408 on near surface 1402. A ground plane 1478 for feed network 1274 is formed in feed portion 1408 of far surface 1400.

In the illustrated embodiment, segments 1208 are comprised of two components or sections, section 1208B deposited on far surface 1400 and section 1208C deposited on near surface 1402. The point at which sections 1208A and 1208B meet is the feed point for radiator 1204. A feed line 1208A is used to transfer signals to and from radiator segment 1208 at the end of radiator section 1208B on far surface 1400.

The length by which feed line 1208A, $l_{feed}$, extends from ground plane 1476, is chosen to optimize impedance matching of the antenna to feed network 1272. The length of feed line 1208A $l_{feed}$ is chosen to be slightly longer than radiator section 1208C. Specifically, in one embodiment it is 0.01 inches (2.5 mm) shorter than 1208A, so that there is an appropriate gap between the ends of radiator sections 1208B and 1208C which feed line 1208A crosses or extends over.

In the illustrated embodiment, radiators 1212 are comprised of two components or sections, section 1212B deposited on near surface 1402 and section 1212C deposited on far surface 1402. The point at which segments 1212B and 1212C meet is the feed point for radiator 1212. A feed line 1212A is used to transfer signals to and from radiator segment 1212 at the end of radiator section 1212B on near surface 1402.

Feed lines 1208A and 1212A are generally disposed on the substrate such that they are opposite and substantially centered over radiator sections 1208C and 1212C, respectively. While the position of feed lines 1208A and 1212A over ground planes 1476 and 1478 may follow the angle of radiator sections 1208C and 1212C, respectively, this is not a requirement and they may connect to feed networks 1272 and 1274 at a different angle, as shown in FIG. 15.

Figure 15:
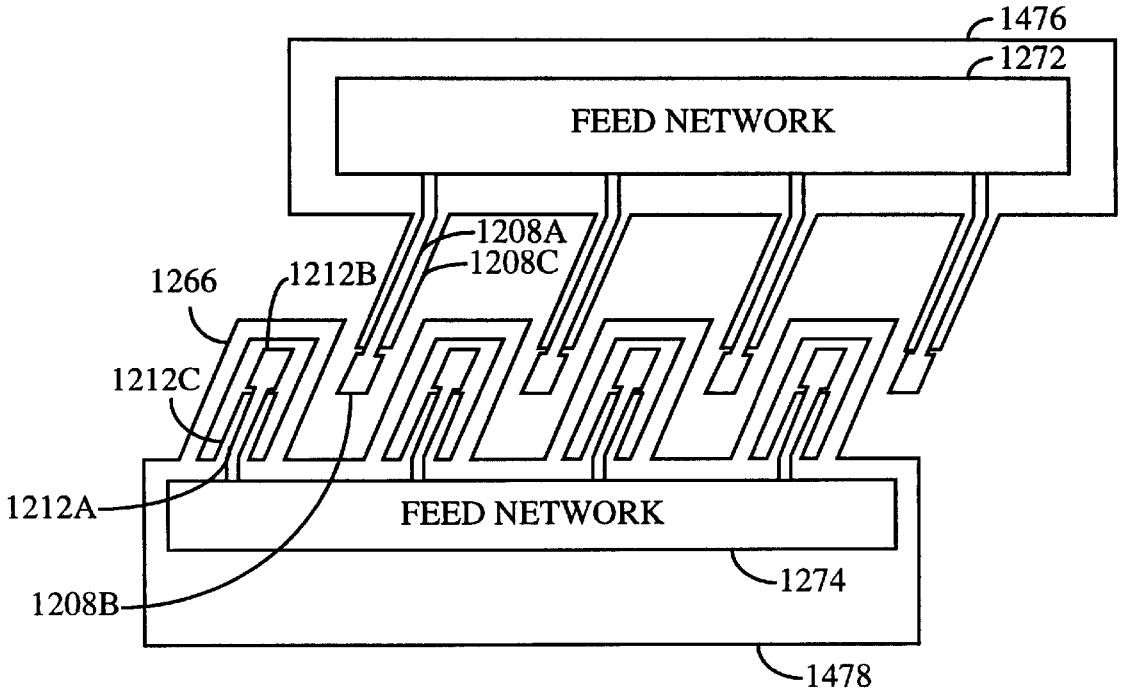
FIG. 15 is a diagram illustrating the near and far surfaces superimposed.

FIG. 15 is a diagram effectively illustrating FIGS. 14A and 14B superimposed over one another. FIG. 15 illustrates how components or sections 1208B, 1208C overlap with feed line 1208A and how sections 1212B, 1212C overlap with feed line 1212A.

Figure 16:
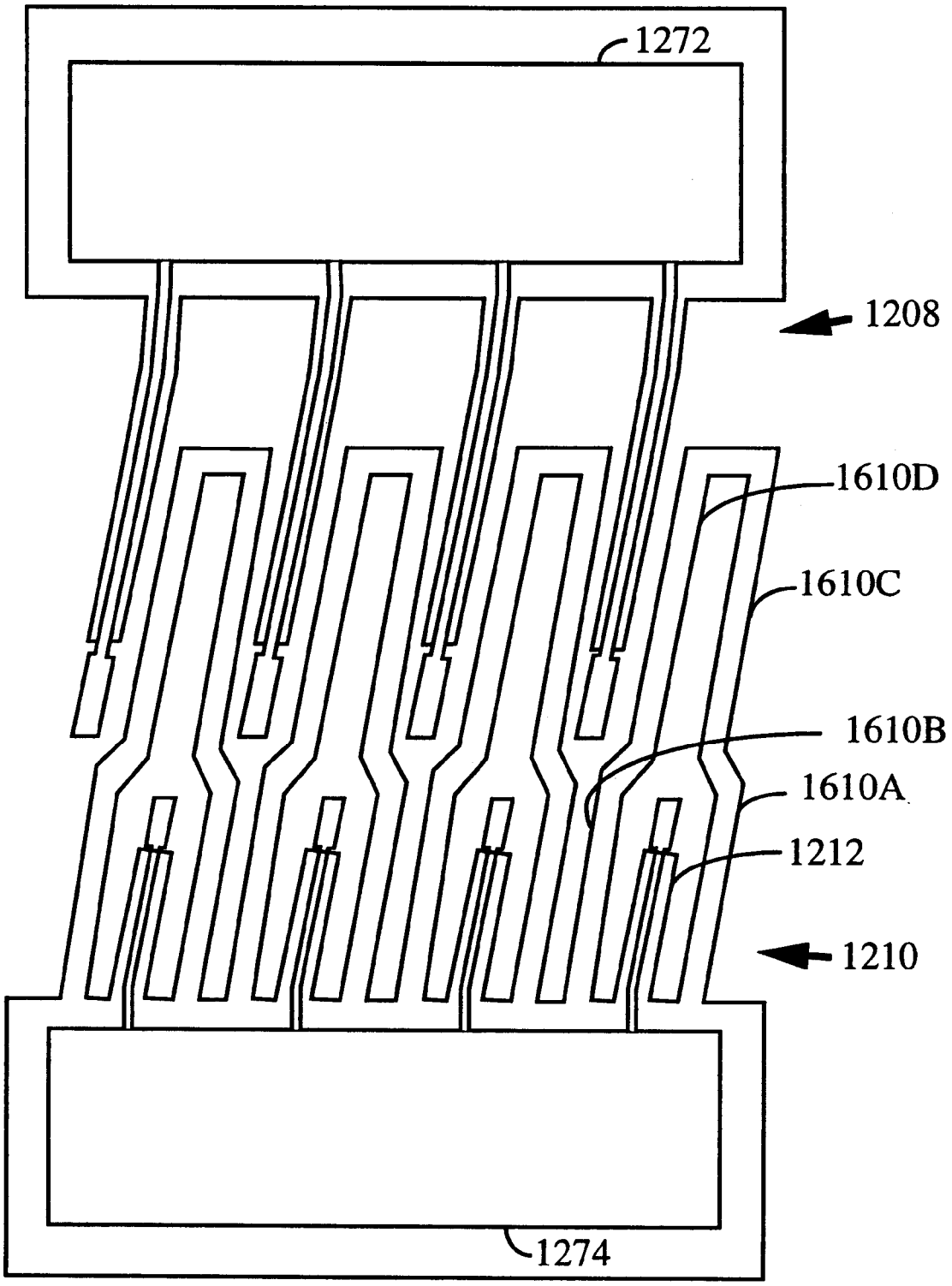
FIG. 16 is a diagram illustrating an exemplary layout (both near and far surfaces) of a dual-band coupled segment helical antenna according to one embodiment of the invention.

FIG. 16 is a diagram illustrating an example layout of a dual-band coupled segment helical antenna according to one embodiment of the invention. Note that in the illustrated embodiment, U-shaped segment 1210 extends beyond the length of radiators 1212. In this embodiment, U-shaped segment 1210 can be described as having two parts. A first part is comprised of two adjacent sections 1610A, 1610B deposited on the substrate and separated by a width that is sufficient to accommodate radiator 1212. A second part of segment 1210 extends beyond the first part and is also comprised of two adjacent sections 1610C, 1610D. However, in the illustrated embodiment, these sections 1610C, 1610D are spaced closer together than sections 1610A, 1610B and preferably could not accommodate the deposition of radiator 1212 therebetween.

As a result of the illustrated structure, segments 1208, 1210 overlap one another without having segment 1208 overlap radiator 1212. Also note that because of this structure, the interleaving of segments 1208, 1210 occurs over a portion of segment 1210 that is narrower, thereby decreasing the diameter of the antenna.

Figure 17:
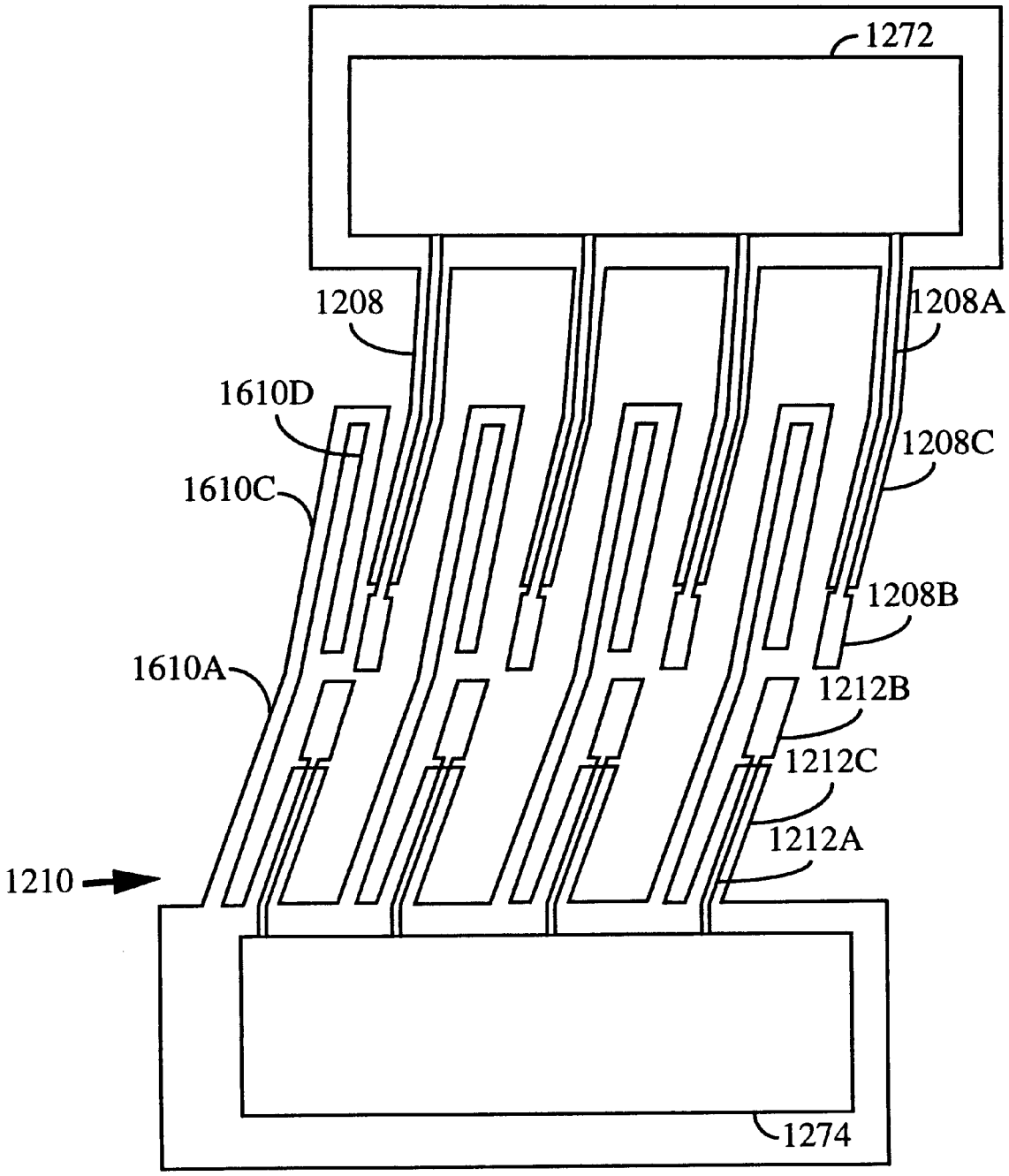
FIG. 17 is a diagram illustrating an exemplary layout (both near and far surfaces) of a dual-band coupled segment helical antenna according to another embodiment of the invention.

FIG. 17 illustrates an example of an embodiment where U-shaped segments 1210 are asymmetrical. In this embodiment, U-shaped segment 1210 does not extend all the way to the feed portion on both sections. Here, segments 1610A, 1610C, and 1610D are again used with no extension of segments 1212A, 1212B, or 1212C into the region encompassed by segments 1610C and 1610D. In this embodiment, segment 1610B is omitted for each radiator portion 1210.

One advantage of the embodiments illustrated in FIGS. 16 and 17 is that for a given radiator portion width, the width of segment 1210 can be increased. Thus, the embodiment illustrated in FIG. 17 can offer increased bandwidth operation for the second frequency.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What I claim as my invention is:

1. A dual-band helical antenna having a radiator portion with a first end and a second end, and a first set of one or more radiators and a second set of one or more radiators, a radiator of said first set of radiators comprising:

a first radiator segment extending in a helical fashion from the second end of the radiator portion toward the first end of the radiator portion; and a U-shaped radiator segment extending in a helical fashion from the first end of the radiator portion toward the second end of the radiator portion;

wherein said U-shaped radiator segment comprises:

a first part comprising two first sections extending from the first end of the radiator portion toward the second end of the radiator portion, wherein said two first sections are separated by a preselected first width; and a second part comprising two second sections extending from said two first sections and spaced at a width that is narrower than said width of said first sections;

and having a third section connected therebetween at ends toward said second end of the radiator portion; and a radiator of said second set of radiators disposed within said U-shaped segment;

whereby said first set of radiators resonates at a first frequency and said second set of radiators resonates at a second frequency.

2. A dual-band helical antenna having a radiator portion with a first end and a second end, comprising:

a first radiator that resonates at a first frequency extending from the first end toward the second end, said first radiator being subdivided into two segments comprising:

a first radiator segment extending in a helical fashion from said second end of the radiator portion toward said first end of the radiator portion, and a second radiator segment extending in a helical fashion from the first end of the radiator portion toward the second end of the radiator portion, said second radiator segment being substantially U-shaped with the closed end positioned toward the second end, said second radiator segment being spaced apart from and overlapping along a length of said first segment, wherein said first radiator segment is in such proximity with said second radiator segment in the area of overlap that said first and second radiator segments are electromagnetically coupled to one another such that said helical antenna resonates at a first selected frequency; and a second radiator that resonates at a second selected frequency extending from the first end toward the second end and being at least partially enclosed by said substantially U-shaped second radiator segment.

3. The helical antenna of claim 2 wherein said radiators comprise strips of conductive material deposited on a dielectric substrate which is shaped such that the radiators are wrapped in a helical fashion.

4. The helical antenna of claim 3, wherein said dielectric substrate is formed into one of a cylindrical shape or a conical shape.

5. The helical antenna of claim 2, wherein said second segment substantially encloses said second radiator on all sides.

6. The helical antenna of claim 2, wherein:

said second radiator segment comprises:

first and second sub-sections connected in series with each other such that they are offset from a common central axis and extend from said first end of the radiator portion to said U-shaped portion of said second radiator segment; and third and fourth sub-sections connected in series with each other such that they are offset from a common central axis and extend from said U-shaped portion toward said first end of the radiator portion;

said first and fourth sub-sections are separated by a first preselected width such that said second radiator can be disposed therebetween; and said second and third sub-sections are separated by a second preselected width narrower than said first preselected width.

7. The helical antenna of claim 6, wherein said first and fourth sub-sections are substantially equal in length, and said second and third sub-sections are substantially equal in length.

8. The helical antenna of claim 6, wherein said first and fourth sub-sections are substantially unequal in length.

9. The helical antenna of claim 2, wherein said first segment is $\lambda_1/4$ in length, where $\lambda_1$ is a wavelength of a first resonant frequency of the antenna.

10. The helical antenna of claim 2, wherein the overall length of said second segment is $\lambda_1$, where $\lambda_1$, is a wavelength of a first resonant frequency of the antenna.

11. The helical antenna of claim 10, wherein the combined length of sections of said second segment is $\lambda_1$.

12. The helical antenna of claim 2, comprising four radiators in each of said first and second radiators and further comprising a feed network for each of said first and second radiators.

13. The helical antenna of claim 2, further comprising a feed point for said first radiator positioned at a distance from the second end along said first segment is chosen to match the impedance of the radiator to a feed network.

14. A dual-band helical antenna having a radiator portion with a first end and a second end, comprising:

a first radiator that resonates at a first frequency extending from the first end toward the second end, said first radiator being subdivided into two segments comprising:

a first radiator segment extending in a helical fashion from said second end of the radiator portion toward said first end of the radiator portion, and a second radiator segment extending in a helical fashion from the first end of the radiator portion toward the second end of the radiator portion, said second radiator segment being substantially J-shaped with the closed end positioned toward the second end, said second radiator segment having a first leg extending from said first end toward said second end, a second leg extending toward said first end, and a connecting portion connecting said first and second legs, said second radiator segment being spaced apart from and overlapping along a length of said first segment, wherein said first radiator segment is in such proximity with said second radiator segment in the area of overlap that said first and second radiator segments are electromagnetically coupled to one another such that said helical antenna resonates at a first selected frequency; and a second radiator that resonates at a second selected frequency extending from the first end adjacent said first leg toward said second leg.

15. The helical antenna of claim 14, wherein:

said second radiator segment comprises a proximal end portion proximate to the first end and a distal end portion extending toward but spaced from said second leg in the direction between the first and second ends.

16. A dual-band helical antenna having a radiator portion with a first end and a second end, comprising:

a first radiator that resonates at a first frequency extending from the first end toward the second end, said first radiator being subdivided into two segments comprising:

a first radiator segment extending in a helical fashion from the second end of the radiator portion toward the first end of the radiator portion; and a second radiator segment extending in a helical fashion from the first end of the radiator portion toward the second end of the radiator portion, said second radiator segment having a bent back portion positioned toward the second end and spaced apart from and overlapping along a length of said first segment;

wherein said second radiator segment comprises:

a first section extending from the first end of the radiator portion to said bent back portion of the second radiator segment and comprising first and second sub-sections connected in series with each other such that they are offset from a common central axis and extending from the first end of the radiator portion to said bent back portion of the second radiator segment, a second section adjacent to said first section and extending from said bent back portion toward the first end of the radiator portion and comprising third and fourth subsections connected in series with each other such that they are offset from a common central axis and extending from said bent back portion toward said first end of the radiator portion, and a third section connecting between said first and second sections in said bent back portion; and a second radiator that resonates at a second frequency extending from the first end toward the second end with said second radiator being at least partially enclosed by said second radiator segment;

wherein said first and fourth sub-sections are separated by a first preselected width such that said second radiator can be disposed therebetween, and said second and third sub-sections are separated by a second preselected width narrower than said first preselected width.

* * * * *